US006712216B2

(12) United States Patent
Van Oirschot

(10) Patent No.: US 6,712,216 B2
(45) Date of Patent: Mar. 30, 2004

(54) METHOD APPARATUS FOR SEPARATING UNWANTED MATTER FROM GRANULAR MATERIAL

(76) Inventor: Frank Van Oirschot, P.O. Box 834, 288 Inshes Avenue, Chatham, Ontario (CA), N7M 5L1

( * ) Notice: Subject to any disclaimer, the term of this patent is extended or adjusted under 35 U.S.C. 154(b) by 0 days.

(21) Appl. No.: 09/985,507

(22) Filed: Nov. 5, 2001

(65) Prior Publication Data

US 2003/0085158 A1 May 8, 2003

(51) Int. Cl.[7] ..... B07B 7/04
(52) U.S. Cl. ..... 209/138; 209/143
(58) Field of Search ..... 209/138, 139.1, 209/140, 141, 142, 143

(56) References Cited

U.S. PATENT DOCUMENTS

| | | | | | |
|---|---|---|---|---|---|
| 422,943 | A | * | 3/1890 | Holt | 209/139.2 |
| 940,469 | A | * | 11/1909 | Middleton | 209/138 |
| 1,231,478 | A | * | 6/1917 | Blankman | 241/189.1 |
| 3,312,342 | A | * | 4/1967 | Brown | 209/3 |
| 3,448,856 | A | * | 6/1969 | Thomson | 209/138 |
| 4,159,941 | A | | 7/1979 | Avery | |
| 4,414,100 | A | * | 11/1983 | Krug et al. | 208/153 |
| 5,281,379 | A | * | 1/1994 | Noguchi et al. | 264/102 |
| 5,840,198 | A | * | 11/1998 | Clarke | 210/802 |
| 5,934,476 | A | * | 8/1999 | Roe | 209/23 |

FOREIGN PATENT DOCUMENTS

| | | |
|---|---|---|
| DE | 1196 949 B | 7/1965 |
| GB | 713 349 A | 8/1954 |
| GB | 857 054 A | 12/1960 |
| GB | 1 135 913 A | 12/1968 |

* cited by examiner

*Primary Examiner*—Donald P. Walsh
*Assistant Examiner*—Joseph C Rodriguez

(57) ABSTRACT

In a method of separating unwanted fine matter from heavier granular matter a flow of the material is produced under vacuum firstly through alternating expansion and contraction passages and then against impact surfaces to cause multiple redirections of the material and separation of the heavier granular material from the material flow.

11 Claims, 4 Drawing Sheets

METHOD APPARATUS FOR SEPARATING UNWANTED MATTER FROM GRANULAR MATERIAL

FIELD OF THE INVENTION

The present invention relates to a method and apparatus for cleaning or separating lighter unwanted matter from heavier granular material. The invention is particularly applicable to cleaning the granular material during transfer thereof from one location to another.

BACKGROUND OF THE INVENTION

Granular material to be used in forming a solid end product can often carry unwanted matter detrimental to the end product. A specific example is ground plastic used as a plastic supply for molding operations and the like. The plastic, in granulated form, may be ground from a larger block of "parent" material. This parent material may be either virgin or recycled material. The granular plastic may also be re-pelletized material.

When working from a solid block of plastic during the grinding or regrinding operation, varying amounts of parent material dusts are generated within and carried by the granulated plastic. Depending on the size of the dust particles, they can create problems in the molded or otherwise produced, end product.

In the case of re-pelletized material this material tends to pick-up unwanted matter which settles on the material during storage thereof.

In the examples given, due to the heat process required, the dusts and other unwanted matter tend to carbonize rather than melt. As such they turn up as impurities in the final product. Accordingly it is important to clean the unwanted matter from the granular plastic material before using it in the product formation process. A particularly suitable time for doing this is when the granular material is being transferred from one location to another.

SUMMARY OF THE PRESENT INVENTION

The present invention provides a method and apparatus for separating or cleaning unwanted fine matter from heavier or more dense granular material. Preferably the flow of the material occurs vertically through a containment and separation housing while the material is being transferred from one location to another e.g. from a supply source to a storage site for the material or from a storage site to a use site for the material.

According to the method of the invention, flow of the material is produced, under vacuum, firstly through alternating expansion and contraction passages and then against impact surfaces to cause multiple redirections of the material. This causes a fallout of the heavier material particles while the lighter unwanted matter is carried away by the vacuum.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH:

The drawings show an apparatus generally indicated at 1 which is used as both a pneumatic conveyer and inertia separator for granular particles conveyed by the apparatus.

Figure 1:
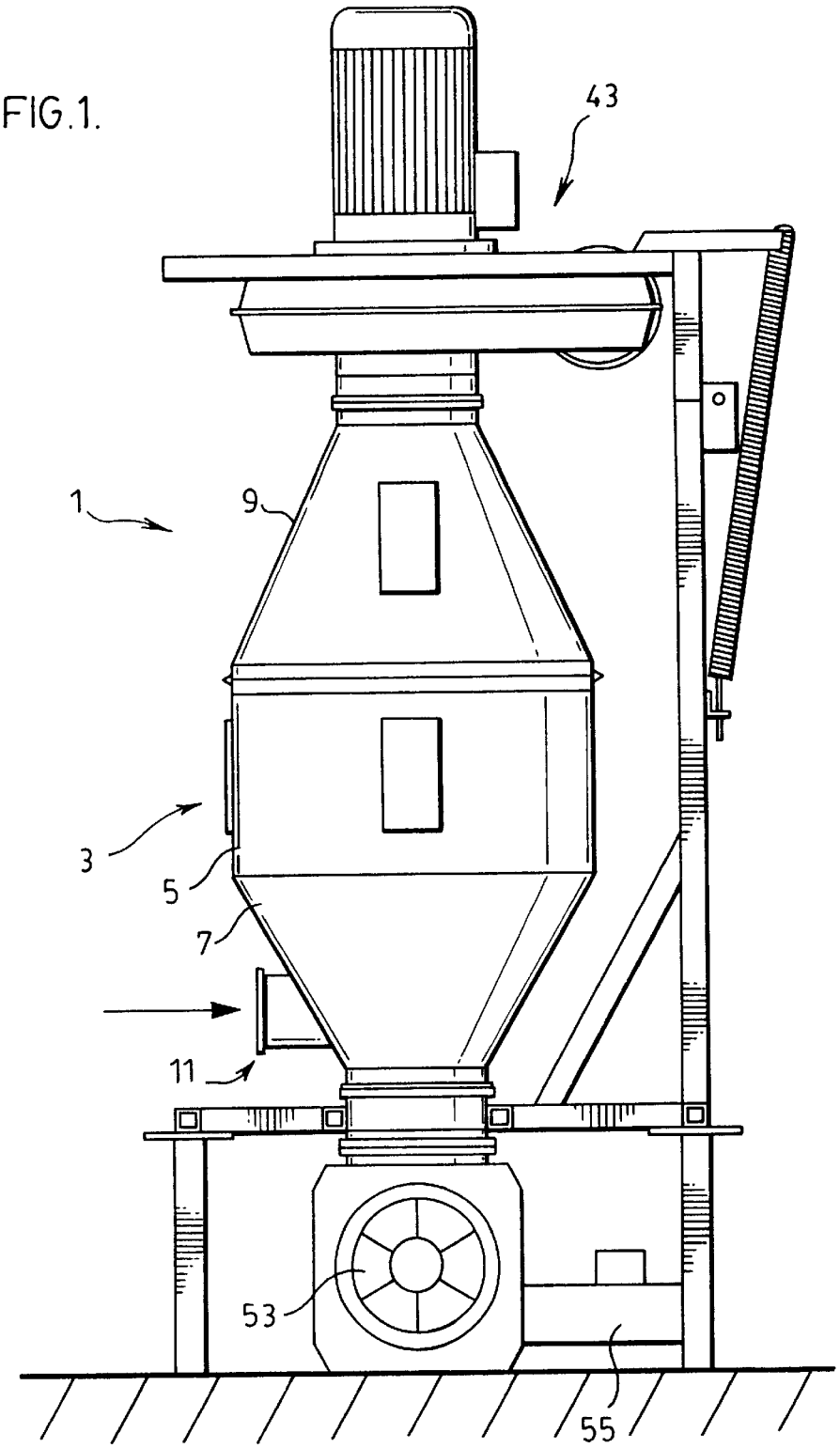
FIG. 1 is an exterior side view of an apparatus for transferring granular material from one site to another while separating unwanted finer matter from the material according to a preferred embodiment of the invention.
Figure 2:
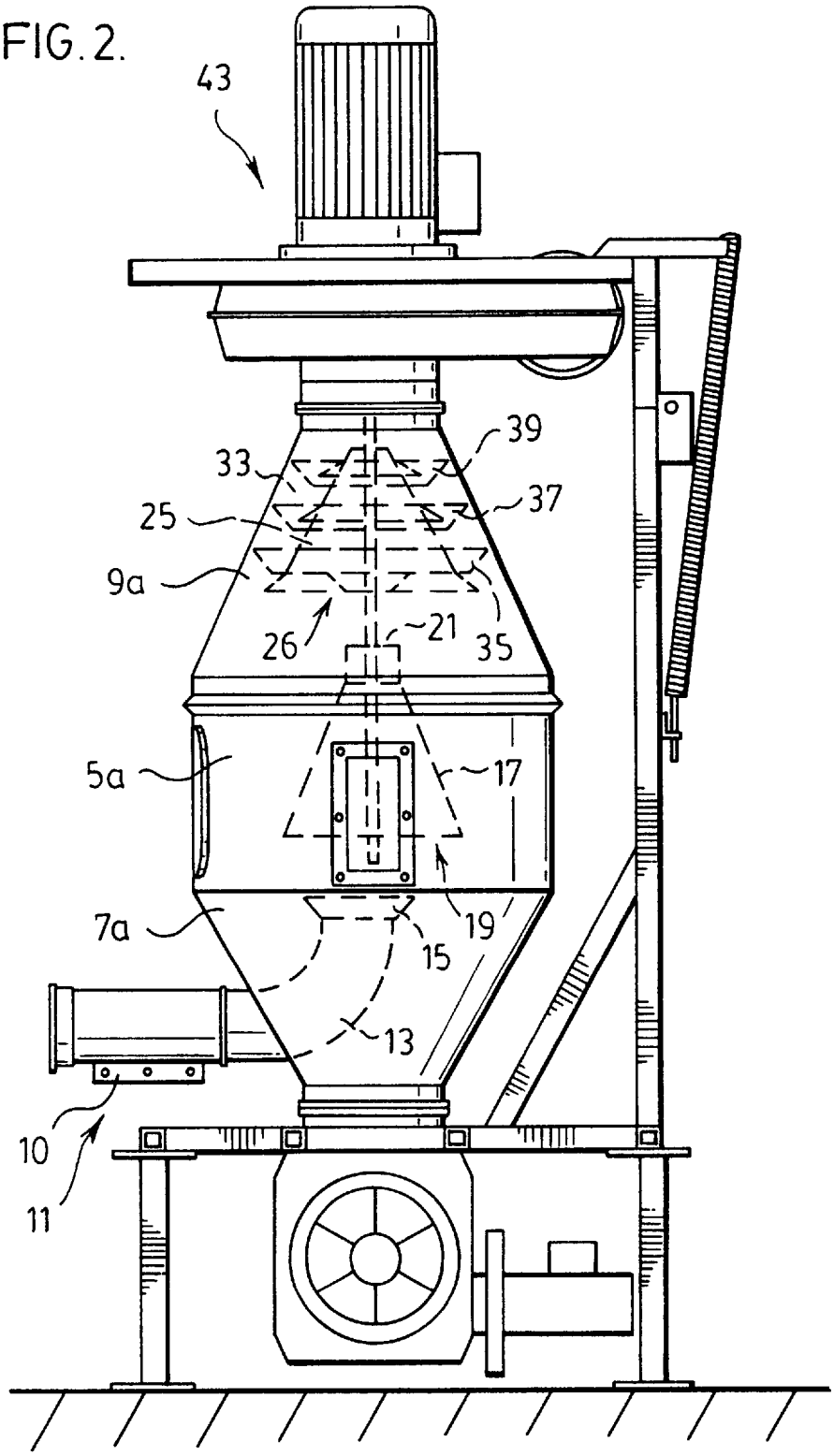
FIG. 2 is a sectional view of the apparatus of FIG. 1.

The main body of the apparatus is formed by a housing generally indicated at 3 which sits in a vertical direction i.e., the housing has a vertical longitudinal axis. This housing acts as both a containment and separation housing for granular material flowing through and cleaned within the housing. This housing has a diametrically enlarged generally cylindrical center portion 5 bordered by lower and upper tapered regions 7 and 9 respectively. A product inlet generally indicated at 11 is brought in from the side of the lower tapered portion of the housing and then turns upwardly at elbow 13 within the housing as shown in FIG. 2. Secured to the upper end of elbow 13 is an upwardly outwardly tapering frusto conical mouth 15.

As also shown in FIG. 2 the housing portions 5, 7 and 9 define interior chamber regions 5*a*, 7*a* and 9*a* within that housing. The movement of the product within these different chamber regions will be described later in detail.

Provided above the inlet mouth 15 is a funnel member 17. This funnel member is again a truncated cone which is hollow having a wider bottom entrance 19 and a narrower top exit 21.

The exit of the funnel member which acts as a direction cone feeds upwardly at a further frusto conical member generally indicated at 25. This member is not however a flow through member but rather has a solid bottom surface providing a distribution plate generally indicated at 26 above the direction cone. The distribution plate is formed by three plate regions namely regions 27, 29 and 31. Plate region 27, centrally of the distribution plate, is angled upwardly outwardly to plate region 29 which is transverse to the longitudinal axis of housing 3. Plate region 31 has a downward outward inclination.

Provided outwardly around cone 25 is product flow passage 33 which is relatively constricted due to the presence of the distribution cone and also due to the upward inward tapering of the housing. Located within the product flow passage are a plurality of frusto conical baffles 35, 37 and 39.

Located above the uppermost baffle 39 is an outlet 41 from the housing as best seen in FIG. 2. Mounted on this outlet is an exhauster generally indicated at 43. This exhauster as best shown in FIG. 3 includes a high speed blower 45 with the housing 3 being on the negative side of the blower and a filter bag 47 being on the positive side of the blower.

The blower includes an air volume control gate 49 which is adjusted to dictate the amount of vacuum produced within the containment and separation housing.

Figure 2A:
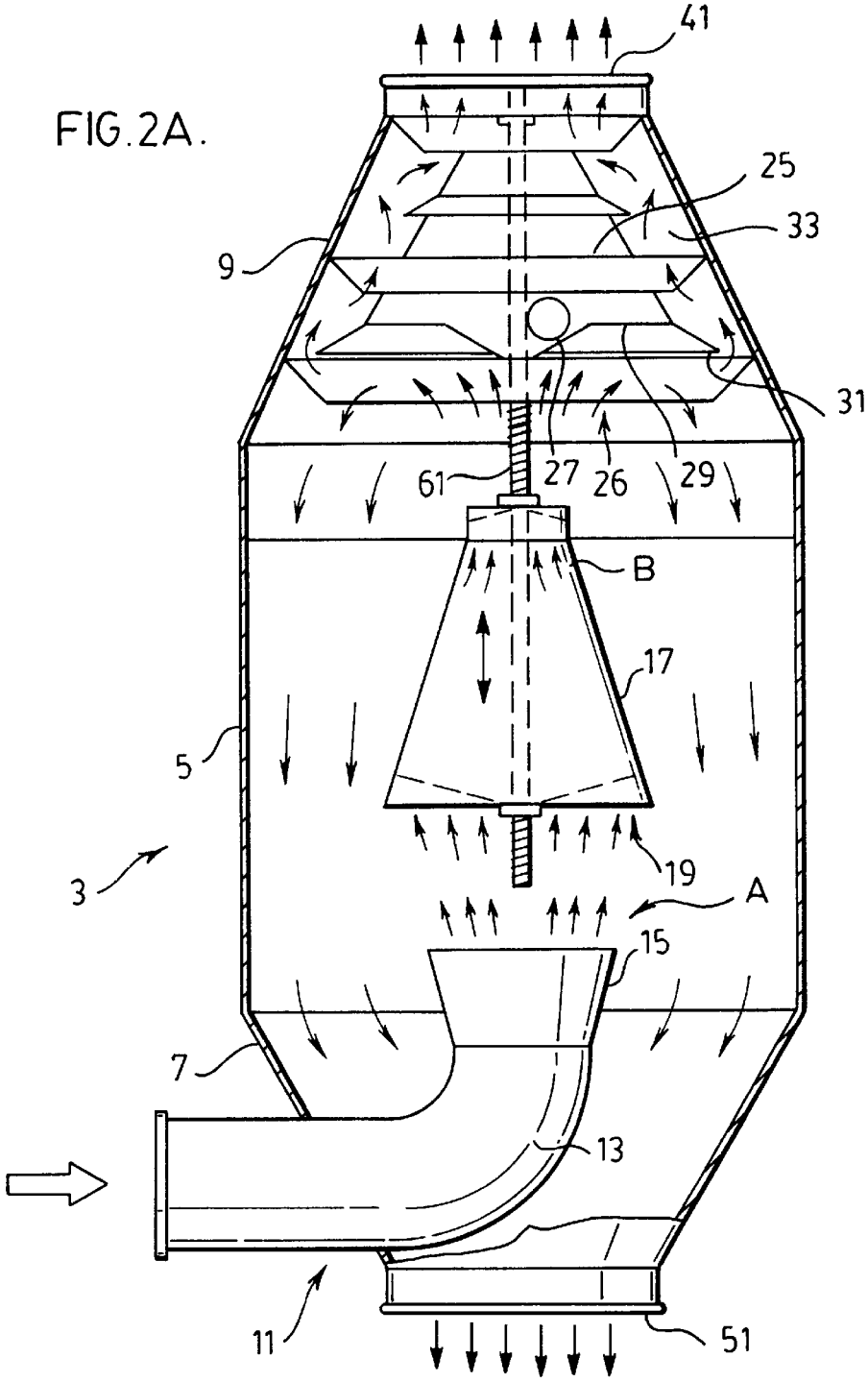
FIG. 2A is a sectional view of the containment and separation housing of the apparatus of FIG. 1 showing product flow through the housing.

The bottom end of the housing also includes an outlet generally indicated at 51 best seen in FIG. 2A of the drawings. Fitted to this outlet is a rotary valve or take away member 53 having an out-feed 55. Out-feed 55 leads to a storage site or other location for product conveyed and treated by the apparatus.

Figure 3:
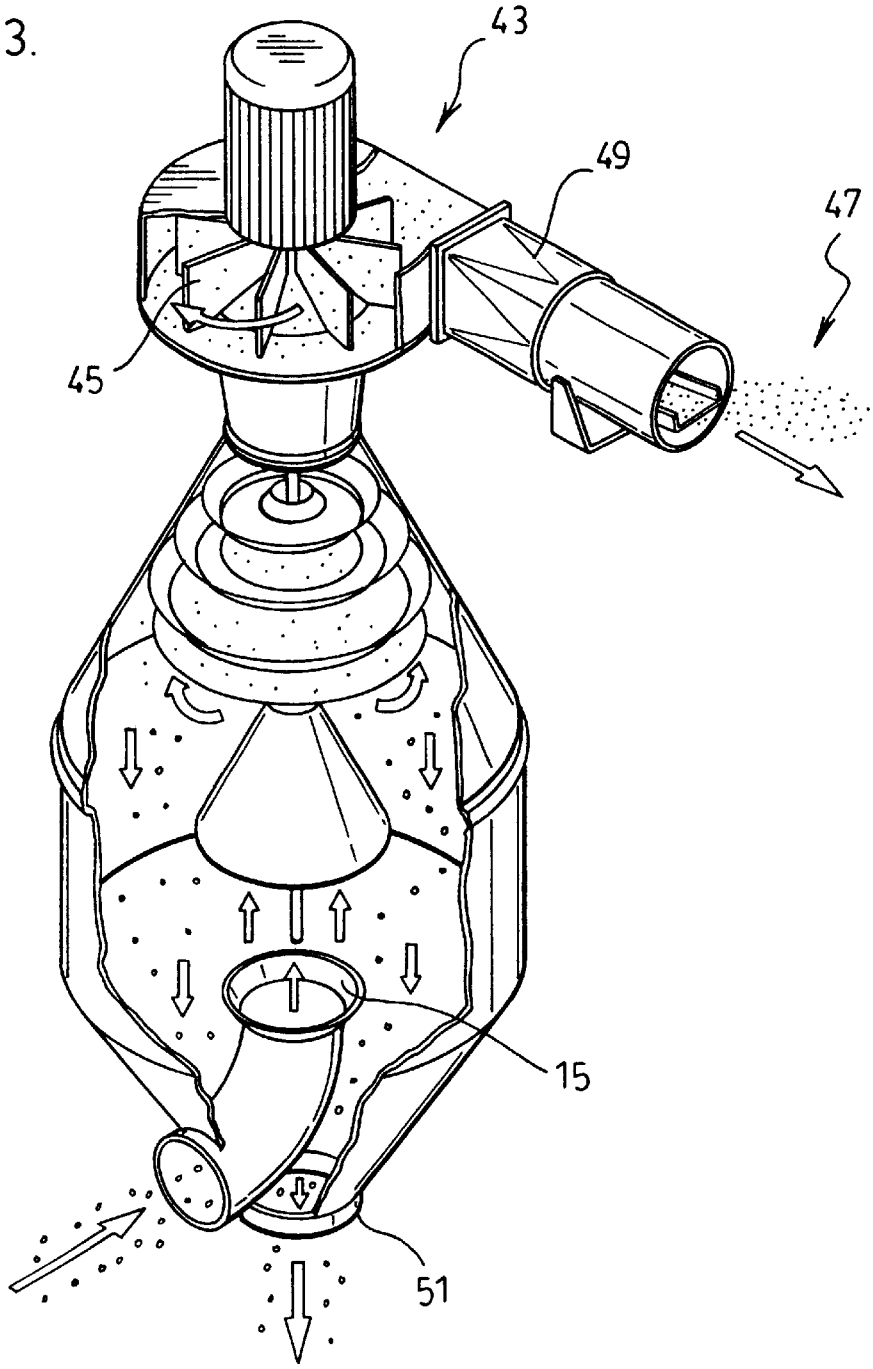
FIG. 3 is a partially sectioned perspective view of the apparatus of FIGS. 1 and 2.

Reference is now had primarily to FIGS. 2A and 3 of the drawings. These two figures best show the flow of material within the apparatus.

As noted above exhauster 45 produces a vacuum within the apparatus below the exhauster. This vacuum acts directly on the inlet 11 to draw product in a particle form e.g., granulated plastic or the like from a supply source, such as a plastic granulator or even a storage bin, through the inlet tube into the housing. This particle material generally carries unwanted matter with it. The unwanted matter is typically much finer or less dense than the particle product.

In the case of just granulated plastic, i.e. plastic coming directly from a granulator the unwanted matter is dust from the parent source of the product as earlier described. In the case of already pelletized material the unwanted matter may be storage dust etc. In any event the relatively dense particle material with finer impurities is drawn at a high rate of speed upwardly from the outward flaring mouth 15 of product inlet. As indicated by the arrows A best seen in FIG. 2A the product not only flows upwardly but in addition expands outwardly from the inlet mouth directed at the bottom entrance 19 of the direction cone 17.

As a result of the upward inward i.e., contracting shape of the direction cone the particle material impacts at a glancing angle with the interior surface of the direction cone and at the same time collects in a heavier flow as indicated by arrows B just below the reduced diameter top exit from the direction cone. As a result of the venturi effect provided in this region of the direction cone the air flow has a tendency to increase in speed relative to the speed at which it enters the lower end of the direction cone. Accordingly, the air flow carrying the material exits from the direction cone at a relatively high rate of speed at and onto the distribution plate 26 on the bottom end of the distribution cone 25.

Distribution plate 26 causes the air flow to once again slow down. The various different regions of the distribution plate cause the air flow to first diverge outwardly upon impact with plate region 27 with the air flow then moving across plate region 29 and finally being redirected downwardly by the flared region 31 of the distribution or deflector plate. However, since the air is still subject to the vacuum of the exhauster it immediately turns around and flows upwardly through passage 33 impacting with and then moving around baffles 35, 37 and 39. Note that the air flow speed through passage 33 once again speeds up due to the constricted size of this passage. This slowing and then increasing speed of the air flow helps to knock the unwanted matter from the air flow as it first impacts and travels around the distribution cone and then impacts with the baffles.

From the description immediately above, it will be seen that the material carrying air flow experiences numerous changes of speed and radical redirections after leaving the direction cone following a more gradual redirection within the direction cone.

While the apparatus produces a conveying of the product from the one source to another the separation of unwanted impurities occurs in different stages. During the initial stage, the heaviest of the granular product will fall out of the air flow in chamber region 5*a* after passing through the direction cone. The redirecting of these as well as the less dense still desirable particles and the change of speed of the air flow through the direction cone will cause the much finer lighter impurities such as dust to be effectively knocked off the heavier particles. This dust continues to be carried upwardly by the air flow as the heavier particles fall downwardly within the apparatus.

Not all of the unwanted particles will however be separated from the air flow after leaving the direction cone. Therefore more of the particles are knocked out of the air flow in chamber region 9*a* when impacting with both the distribution plate and the baffles between the direction cone and the outlet of the housing.

By the time the air flow actually reaches outlet 41 essentially all of the desired particles which are relatively heavy compared to the impurities have been knocked out of the air flow. For example, when working with granulated plastic particles the apparatus separates about 95% of the unwanted dust from the virgin material.

This unwanted dust is directed past the blower to filter bag 47 which traps essentially all of the dust such that the apparatus is extremely environmentally friendly.

The now cleaned material which is separated from the air flow in the housing falls downwardly into chamber region 7*a* at the tapered lower end portion 7 of the housing. This housing portion gathers the material which then falls down into the rotary valve take away member 53 which forces the material along out feed 55 to a desired site for the material.

As mentioned above, the amount of vacuum provided by blower 45 is adjustable by the air volume control gate 49. As to be understood more vacuum is desired when working with heavier particles with the amount of vacuum being adjusted to decrease for use with lighter particles.

The volume is not the only feature which is adjustable according to the size or density of particles to be transferred by the apparatus. In particular, the two cones 17 and 25 are thread mounted on an adjustment rod 61 extending down from the top outlet 41 into housing 3 along its center axis. Both of these cones are adjustable upwardly and downwardly along rod 61 independently of one another. It should be noted that cone 25 can be adjusted downwardly from its uppermost position shown in FIG. 2A to a position which would increase the width of passage 33 formed between the tapered walls of the distribution cone and the tapered walls of the housing to affect the speed of the particles passing through this passage. In addition, adjustment of either or both of the cones can provide different degrees of spacing between the exit end of the direction cone and the distribution plate on the bottom of the distribution cone.

By adjusting the direction cone downwardly the bottom entrance mouth on the direction cone can be brought into much closer proximity to the mouth 15 of the inlet tube. Furthermore, the inlet tube itself as best seen in FIG. 2 of the drawings is held in position by a releasable bracket 10 which allows lateral adjustment of the inlet tube relative to housing 3. This lateral adjustment enables the inlet mouth 15 to either be centered or off centered relative to the entrance of the direction cone. When the inlet mouth is brought to a more off center position as shown in FIG. 2 the air flow tends to carry the material into a greater impact position with the body of the direction cone as compared to a lower impact position centrally up through the cone as is the case when the inlet mouth is centered relative to the cone.

All of the above adjustments are extremely useful to vary the setup of the apparatus according to the type, e.g. density of the particle product to be transferred and cleaned by the apparatus.

Although various preferred embodiments of the present invention have been described in detail, it will be appreciated by those skilled in the art that variations may be made without departing from the spirit of the invention or the scope of the appended claims.

What is claimed is:

1. Apparatus to separate unwanted fine matter from granular material fed to said apparatus, said apparatus comprising a housing defining a substantially hollow chamber, an inlet to and an outlet from said chamber through said housing, said inlet having an outwardly tapering mouth located interiorly of said housing, a funnel member located downstream of and aligned with the mouth of said inlet, said funnel member having a wide entrance opening and a narrow exit opening, a deflector plate downstream of and facing the exit opening of the funnel member, a plurality of baffles between said deflector plate and said outlet from said chamber, and a source of vacuum to produce a material carrying airflow through said inlet, along said chamber, and past said outlet of said apparatus, said housing having a vertical orientation and said outlet from said chamber being located above said inlet to said chamber, and said funnel member and said deflector plate being vertically aligned with one another between said inlet and said outlet of said apparatus, said mouth of said inlet being mounted on a tube which is laterally adjustable of the housing to adjust the positioning of the mouth of said inlet relative to the entrance opening of said funnel member.

2. Apparatus as claimed in claim 1 wherein said funnel member is adjustable vertically of said housing.

3. Apparatus as claimed in claim 2 wherein said funnel member is suspended in said housing on a rod and moves up and down said rod for vertical adjustment of said funnel member.

4. Apparatus as claimed in claim 3 wherein said deflector plate is vertically adjustable of said housing.

5. Apparatus as claimed in claim 4 wherein said deflector plate comprises a base part of an air flow distribution cone and said cone is vertically adjustable of said housing.

6. Apparatus as claimed in claim 5 wherein said cone is adjustably mounted on said rod.

7. Apparatus as claimed in claim 6 wherein said funnel member and said cone are threaded onto said rod.

8. Apparatus as claimed in claim 1 wherein said deflector plate has a center region, an intermediate region, and an outer region, said center region of said deflector plate being located above said exit opening of said funnel member and having a shape which diverges outwardly to said intermediate region of said deflector plate, said intermediate region of said deflector plate being transverse to said vertical orientation of said housing and said outer region of said deflector plate being flared downwardly outwardly from said intermediate region of said deflector plate.

9. Apparatus as claimed in claim 1 wherein said housing has a main cylindrical body portion with tapered upper and lower end portions to each end of said housing, said chamber inside said housing having an enlarged center area and smaller upper and lower end areas, said funnel member being located in said enlarged center area and said deflector plate being a base part of an air flow distribution cone which is located in said upper end area of said chamber.

10. Apparatus as claimed in claim 9 wherein said lower end area of said chamber comprises a material collecting region of said apparatus and wherein said apparatus includes a rotary valve beneath said lower end portion of said housing for removing the material from the apparatus.

11. Apparatus as claimed in claim 1 wherein said source of vacuum is provided by a high speed blower mounted at said outlet from said chamber, said blower including an exhaust discharge fitted with a filter bag for collecting such unwanted matter separated from the granular material.

* * * * *